US005988410A

United States Patent [19]

Mandle

[11] Patent Number: 5,988,410

[45] Date of Patent: Nov. 23, 1999

[54] DISPLAY RACK

[75] Inventor: James S. Mandle, Woodcliff Lake, N.J.

[73] Assignee: Warner-Lambert Company, Morris Plains, N.J.

[21] Appl. No.: 08/904,999

[22] Filed: Aug. 1, 1997

[51] Int. Cl.[6] ..... A47F 1/04; A47F 3/14; A47F 5/12; A47B 88/00

[52] U.S. Cl. ..... 211/133.1; 211/126.15; 211/59.2; 211/170; 312/334.7

[58] Field of Search ..... 211/59.2, 133.1, 211/85.17, 126.15, 170, 131.2; 248/22.201, 224.7; 312/300, 334.7, 322, 312, 313

[56] References Cited

U.S. PATENT DOCUMENTS

| | | | |
|---|---|---|---|
| Re. 22,644 | 5/1945 | Stroben | 248/224.7 X |
| 1,736,655 | 1/1929 | Lombardini | 312/323 |
| 2,140,663 | 12/1938 | Bailey | 248/220.21 X |
| 3,126,101 | 3/1964 | Katterjohn | 211/133.1 X |
| 3,328,106 | 6/1967 | Mullin | 312/334.7 |
| 3,393,808 | 7/1968 | Chirchill . | |
| 3,528,558 | 9/1970 | Williams . | |
| 3,598,246 | 8/1971 | Galli . | |
| 3,627,398 | 12/1971 | Reese . | |
| 3,699,610 | 10/1972 | Harby | 248/220.21 X |
| 4,314,734 | 2/1982 | Grunert | 312/322 |
| 4,387,810 | 6/1983 | Crosslen . | |
| 4,441,771 | 4/1984 | Roesler | 312/322 |
| 4,640,145 | 2/1987 | Ando | 348/447 |
| 4,785,944 | 11/1988 | March . | |
| 4,923,070 | 5/1990 | Jackle et al. . | |
| 4,930,738 | 6/1990 | Lombardo | 248/220.21 X |
| 5,000,329 | 3/1991 | Luberto | 211/133.1 X |
| 5,048,699 | 9/1991 | Trevaskis . | |
| 5,129,525 | 7/1992 | Maynard, Jr. | 211/133.1 X |
| 5,154,388 | 10/1992 | Margaro . | |
| 5,167,391 | 12/1992 | Simpson | 248/220.21 |
| 5,249,763 | 10/1993 | Weber et al. | 248/220.21 X |
| 5,262,923 | 11/1993 | Batta et al. | 312/333 |
| 5,284,257 | 2/1994 | Schum . | |

FOREIGN PATENT DOCUMENTS

| | | |
|---|---|---|
| 29705477 | 7/1997 | Germany . |
| 29707628 | 7/1997 | Germany . |

*Primary Examiner*—David M. Purol
*Assistant Examiner*—Jennifer E. Novosad
*Attorney, Agent, or Firm*—Charles W. Almer

[57] ABSTRACT

A display rack for displaying boxes, especially boxes containing a plurality of smaller product packages (such as mint packages), comprising a base and a stand having a plurality of openings. Swing arms with lock slots are adapted to extend from two opposing sides of the openings and engage with the product boxes being displayed. The swing arms are moveable inward and outward within a slot in the rack and are such that the arms may be either perpendicular to the vertical axis of the rack, when the arms are adjacent to the back of the rack, or tilted downward when the swing arms are distanced from the back of the rack. Consequently, the engaged product boxes may be located in a level position at the back of the rack (a position which is especially useful for loading, transport and storage) or they may be tipped in a downward position at the front of the rack to prominently display the product. The boxes are uniquely designed to include slots which accommodate the ends of the swing arms and thus hold the boxes in place in the rack and also allow for easy replacement of the boxes in the rack. In addition, a lock tab on the swing arms is engageable with openings in the boxes to removably lock the swing arms and the boxes together.

13 Claims, 9 Drawing Sheets

DISPLAY RACK

BACKGROUND OF THE INVENTION

1. Field of the Invention

This invention relates to racks used for displaying boxes of goods, especially boxes which contain a plurality of smaller product packages.

2. Description of Related Art

It is commonly known that there is a need to properly display retail goods for sale. This need encompasses the desire of the retailer to display goods in an efficient and economical manner which is clean, neat and highly visible to potential consumers. One type of display rack which is commonly used involves downwardly-inclined trays which provide a gravity feed so that the product slides to the front, and most visible, portion of the display. This type of rack is especially useful in the situation where either small goods or small boxes of goods are being displayed. The ability to display goods is, however, tempered by the reality of space limitations in retail outlets and the difficulties in loading racks with product. In addition, it is important that the manufacture and loading of the display rack be as efficient and economical as possible. With regard to loading, it is important that the display be capable of quick, simple loading. Consequently, it would be advantageous to provide a display rack which would display goods in a clean, neat and visible manner, yet would not require an unwieldy amount of retail space and would be simple to manufacture and load.

A number of existing patents disclose various forms of display racks. For example, U.S. Pat. No. 4,785,944, issued to March, discloses a collapsible display rack having downwardly-extending shelves. U.S. Pat. No. 5,048,699, issued to Trevaskis, discloses a display stand for selling boxed merchandise in which the trays are movable from a horizontal to a downward position. Finally, U.S. Pat. No. 5,284,257, issued to Schum, discloses a modular self-service merchandise display rack having a plurality of downwardly-inclined shelf-like tiers. While all of the known display racks provide various features, none provide the combination of factors which include ease of loading and manufacture, economization of retail space and neat presentation of the goods which are in relatively small packages. Consequently, it would be advantageous to describe a display rack which provides the combination of desireable factors set forth above.

SUMMARY OF THE INVENTION

The present invention discloses a display rack for displaying boxes, especially boxes containing a plurality of smaller product packages (such as mint packages), comprising an upright stand having a plurality of openings. Swing arms with lock means are adapted to extend from two opposing sides of the openings and engage with the product boxes being displayed. The swing arms are moveable inward and outward within a slot in the rack and are such that the arms may be either perpendicular to the vertical axis of the rack, when the arms are adjacent to the back of the rack, or tilted downward when the swing arms are distanced from the back of the rack. Consequently, the engaged product boxes may be located in a level position at the back of the rack (a position which is especially useful for loading, transport and storage) or they may be tipped in a downward position at the front of the rack to prominently display the product. The boxes are uniquely designed to include slots which accommodate the ends of the swing arms and thus hold the boxes in place in the rack and also allow for easy replacement of the boxes in the rack. In addition, a lock tab on the swing arms is engageable with openings in the boxes to removably lock the swing arms and the boxes together.

DETAILED DESCRIPTION OF THE PREFERRED EMBODIMENTS

Reference will now be made in detail to the presently preferred embodiments of the present invention.

Figure 1:
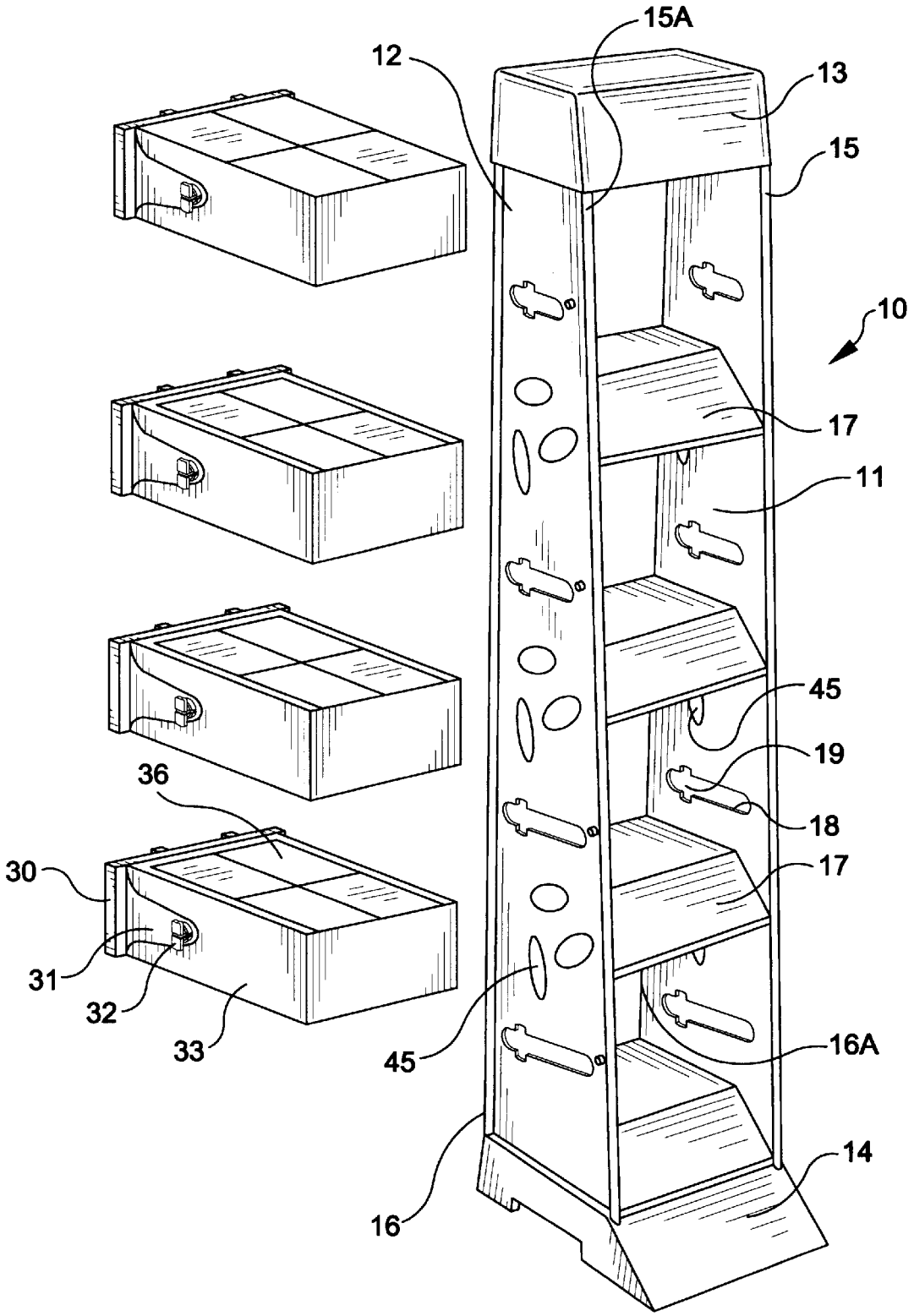
FIG. 1 is a perspective view of the display rack with the swing arms and boxes removed.

As illustrated in FIG. 1, the display rack 10 of the present invention comprises two opposing side walls 11, 12 which are spaced at a distance apart from each other. Each of the side walls has a front end 15, 15A and a back end 16, 16A respectively. In the preferred embodiment, the front ends of the side walls are tapered inward toward the back side of the side walls. The side walls are supported on the bottom by base 14 and on top by cap 13. A series of horizontally elongated slots 18 are located on each side wall, with the slots of each wall being aligned with the slots on the opposing wall. Although a display rack with four sets of slots is illustrated, any number of slots may be employed as desired, and the overall display rack may be as short or as tall as desired. As will be later described, the slots are sufficiently apart vertically so as to allow inserts to be placed within each slot. A portion of each slot which is located near the end of the slot adjacent to the back ends of the side walls is a vertically elongated opening 19 having a wider diameter than the remainder of the slot. Guide rails 17 extend across the gap between the side walls at a position below slots 18. The guide rails consist of two sections, the section near the back ends of the sidewalls is horizontal while the section near the front ends of the sidewalls is angled downward. In a preferred embodiment, variously shaped cutouts 45 may be located, either randomly or in a pattern, along one or both of the side walls. The cutouts may be utilized to provide a hand or finger grip on the side of the display rack.

Figure 2:
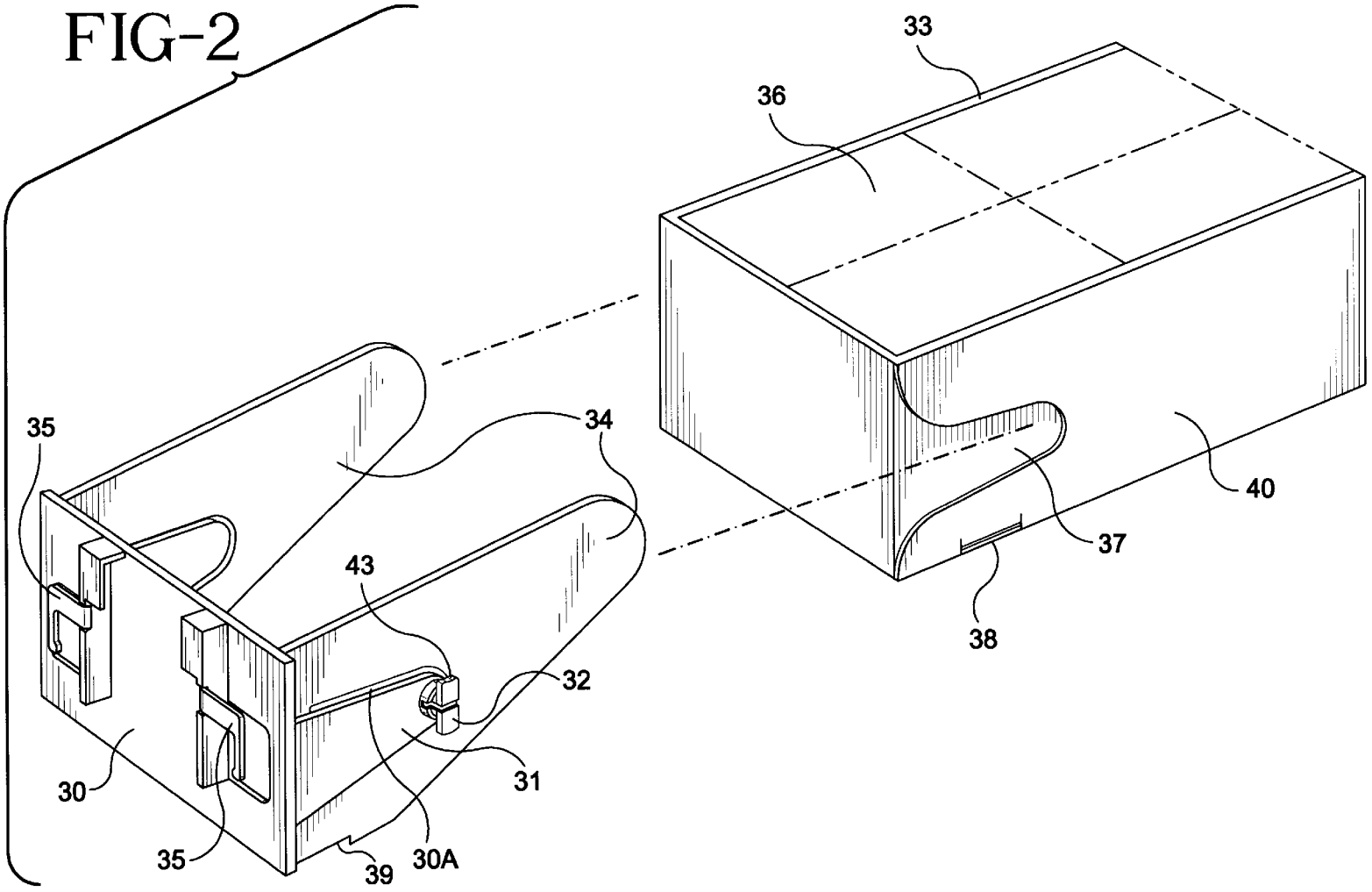
FIG. 2 is a perspective view of the swing arms and boxes.
Figure 4:
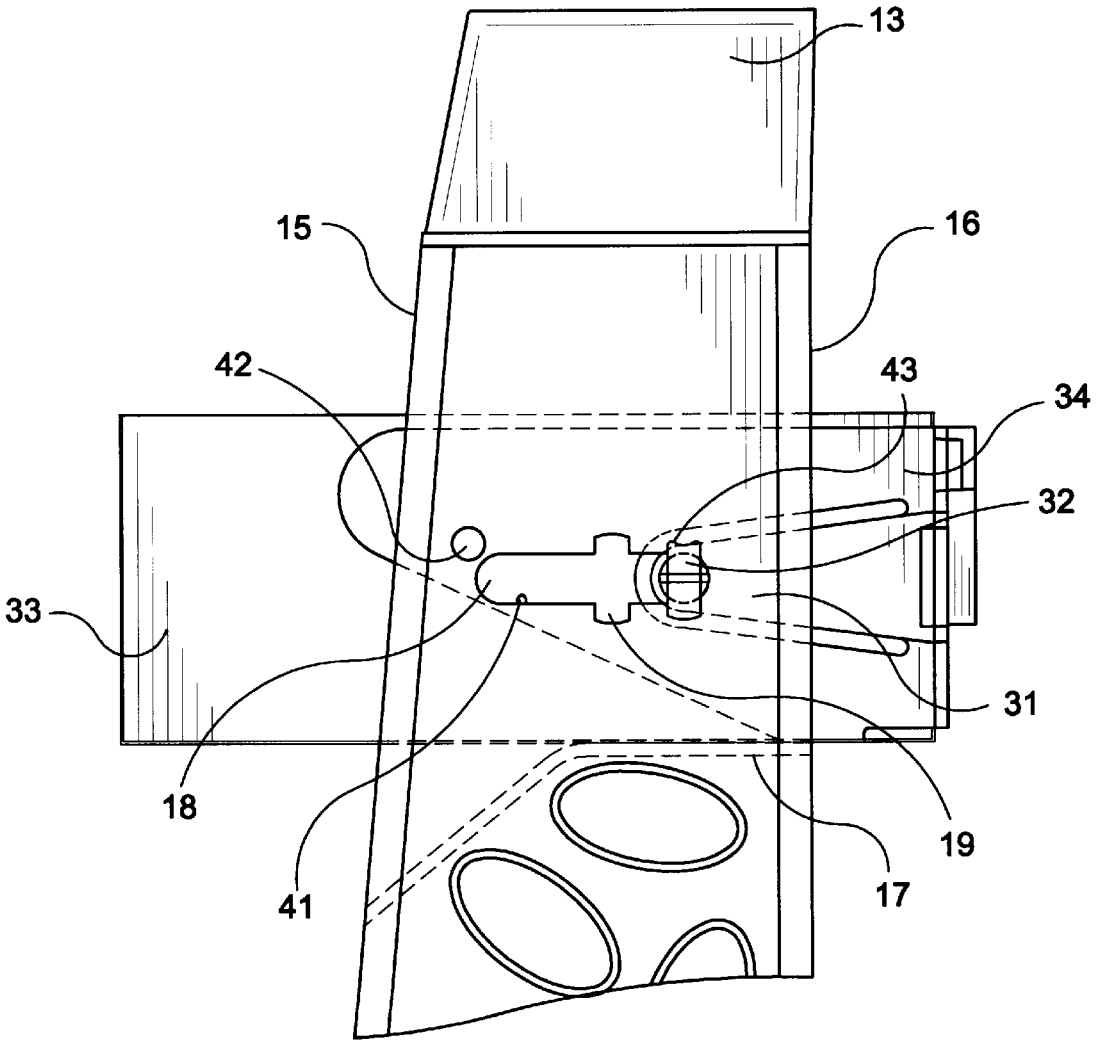
FIG. 4 is a closeup of a portion of the side view of the display rack with the boxes in the back position.
Figure 7:
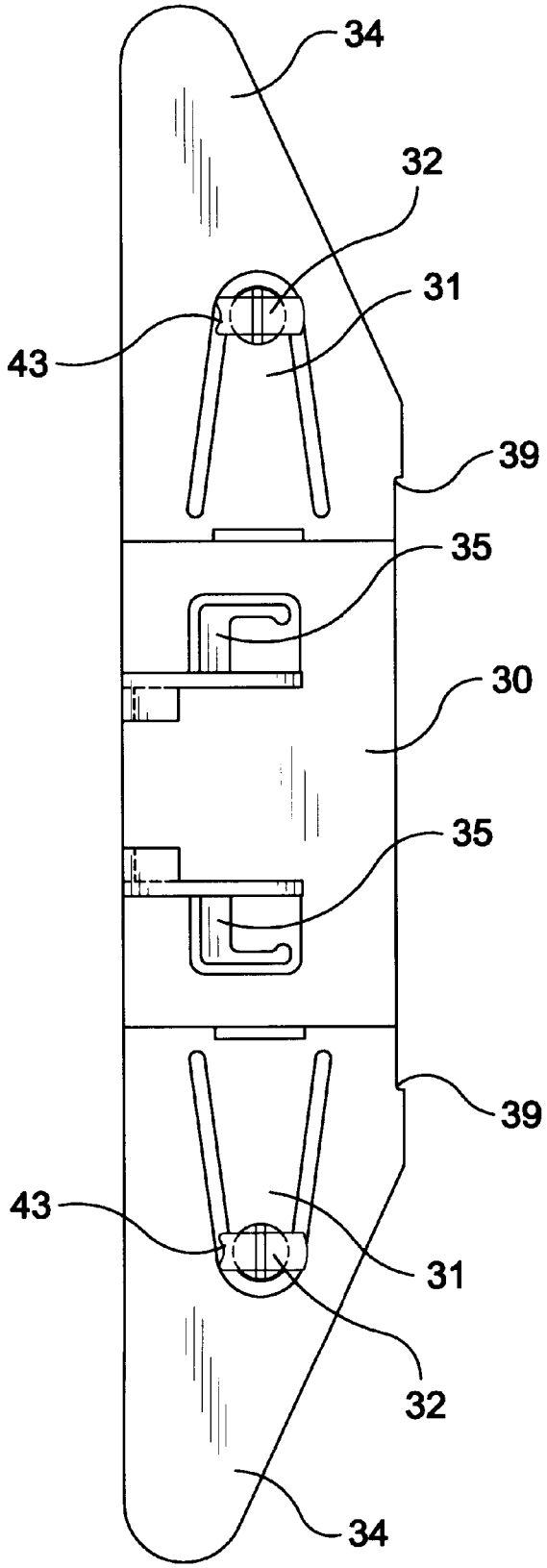
FIG. 7 is a front view of the swing arms of the display rack.

As best illustrated in FIGS. 2 and 7, means for attaching the product box within the display rack are also provided. Preferably, the means for attaching comprise a base plate 30 having two opposing swing arms 34 located adjacent either end of the base plate. The swing arms are foldable inward onto the base plate or outward away from the base plate and may be extended, as illustrated, away from the base plate. In the extended position, the swing arms are preferably biased outward or away from each other. The swing arms contain an elevated portion 31 which extends outward from the base plate to approximately the middle of the swing arm. The elevated portion is constructed so as to be free on three sides and acts as a spring mechanism which forces the tab outward to aid in assembly. The elevated portion contains a hook means, preferably in the form of tab 32. Tabs 32 comprise an elongated portion of a small diameter and a round portion of a larger diameter. The diameters are preferably such that the round portion will fit through the elongated opening 19, but not the slot 18, while the elongated portion of tab 32 is long enough so that the tab will extend through slot 18 and consequently be slidable within slot 18. In the preferred embodiment, dimpled portion 43, as illustrated in FIGS. 2 and 4, is provided on a portion of tab 32 in order to aid in maintaining stability of the displayed product box. In an especially preferred embodiment, additional attachment means in the form of hook 35 are located on the back of the baseplate. Hook 35 may be folded flat against the back of the base plate or extended to attach the base plate to a surface.

Box 33, which preferably may contain smaller product boxes 36, is adapted to accommodate the swing arms via a dual wall arrangement on each side of the box. A portion of outer wall 40 is cut away on each side to reveal inner wall 37. Preferably, the cut away portion is substantially the same size and shape as the elevated portion 31 of the swing arm. Further, a slot is created on both sides of the box between the inner and outer walls of the box over the entire length of the box. Each slot is capable of accomodating one entire swing arm 34. Openings 38 are located on either side of the box in the creased score in the middle at the base of the cut out portion. These openings accommodate tabs 39 which are located on the base of each swing arm. Upon insertion of the swing arms into the slots, tabs 39 engage with openings 38 to lock the box and swing arms together. The openings and tabs may be disengaged by applying direct upward force on the portion of the tabs which extend through the opening.

Figure 3:
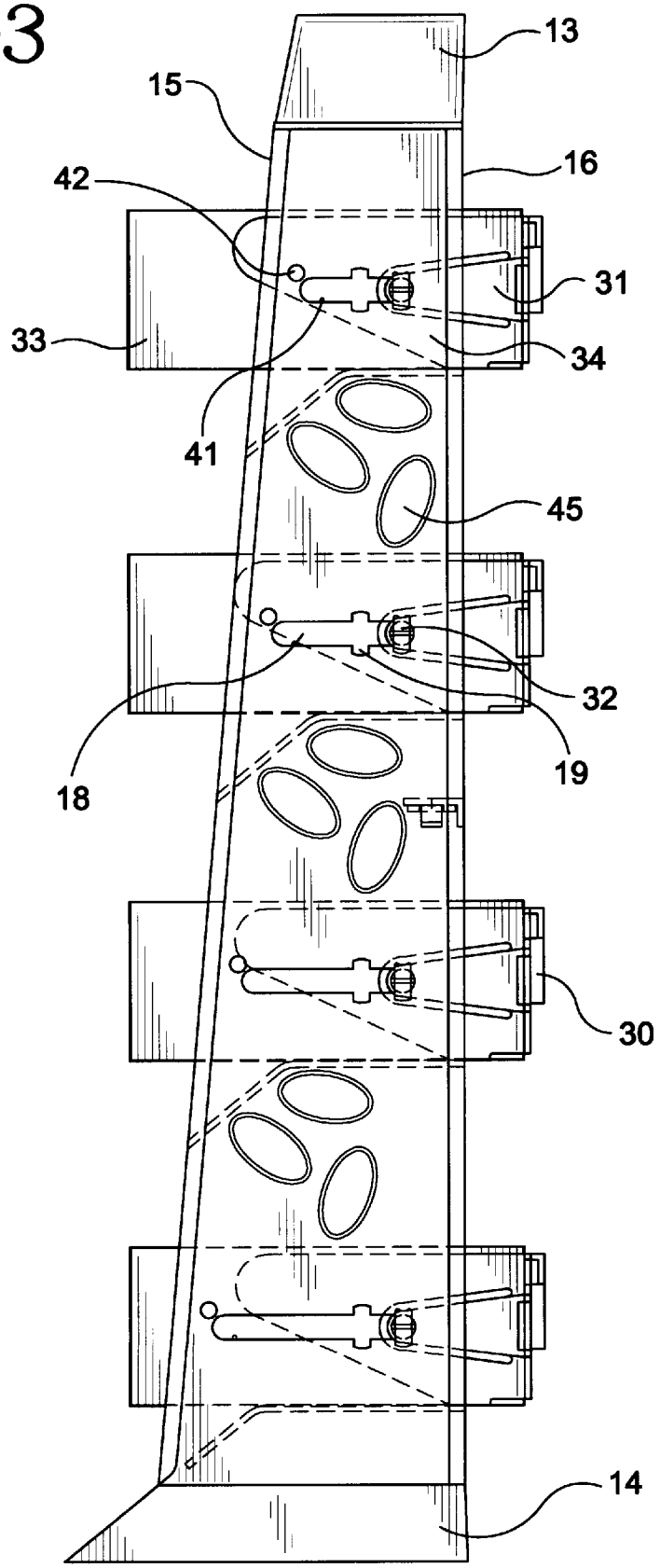
FIG. 3 is a side view of the display rack with the boxes in the back position.

FIGS. 3 and 4 illustrate the display rack having the box and swing arm combination inserted in the shipping position. To obtain the shipping position, the box and swing arm combination is inserted into the opening between the back ends 16, 16A of the sidewalls and tabs 32 are placed within the vertically elongated openings 19. Consequently, the box 33 is in a horizontal position such that it rests upon the horizontal portion of guide rails 17 and extends out beyond both the front ends 15, 15A of the side walls and the back ends 16, 16A of the side walls. The shipping position illustrated in FIGS. 3 and 4 provides a stable unit which is suitable for storage or shipping.

Figure 5:
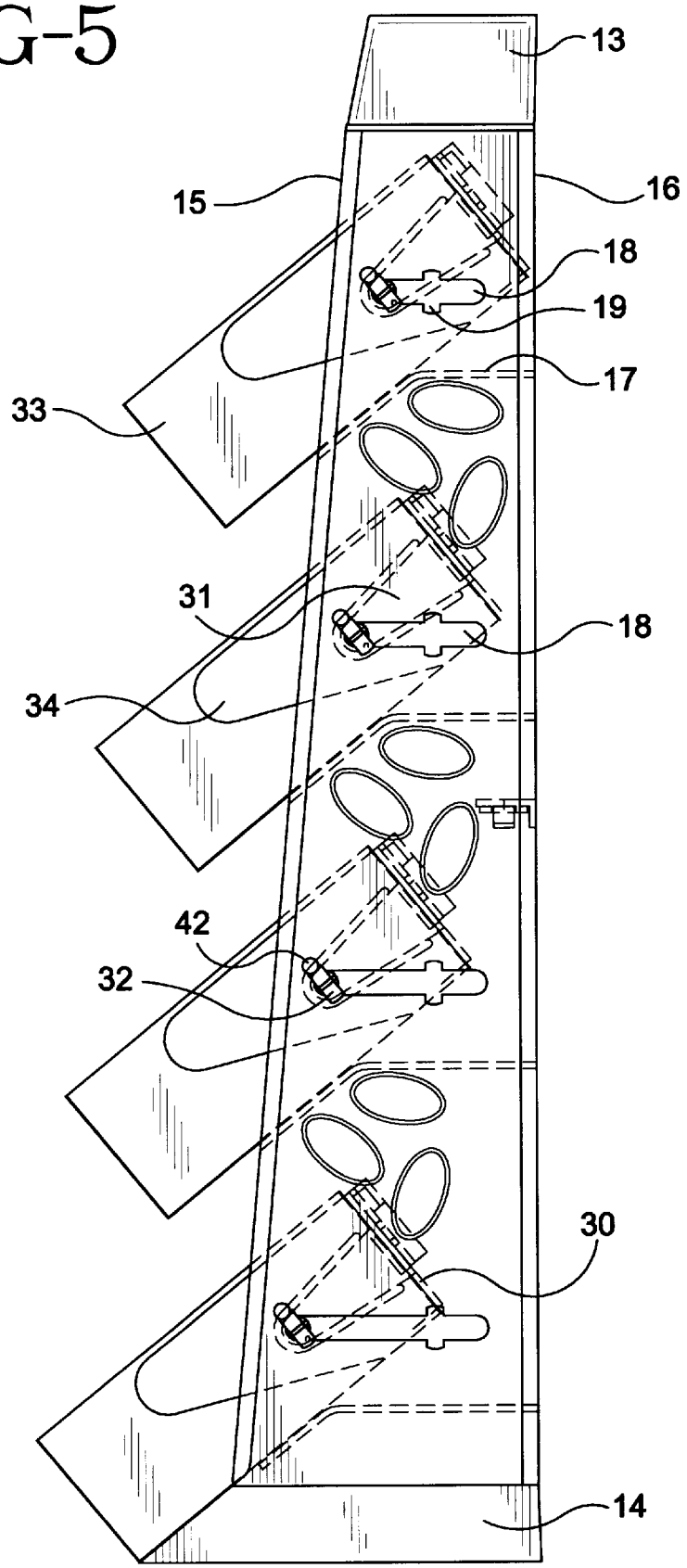
FIG. 5 is a side view of the display rack with the boxes in the front position.
Figure 6:
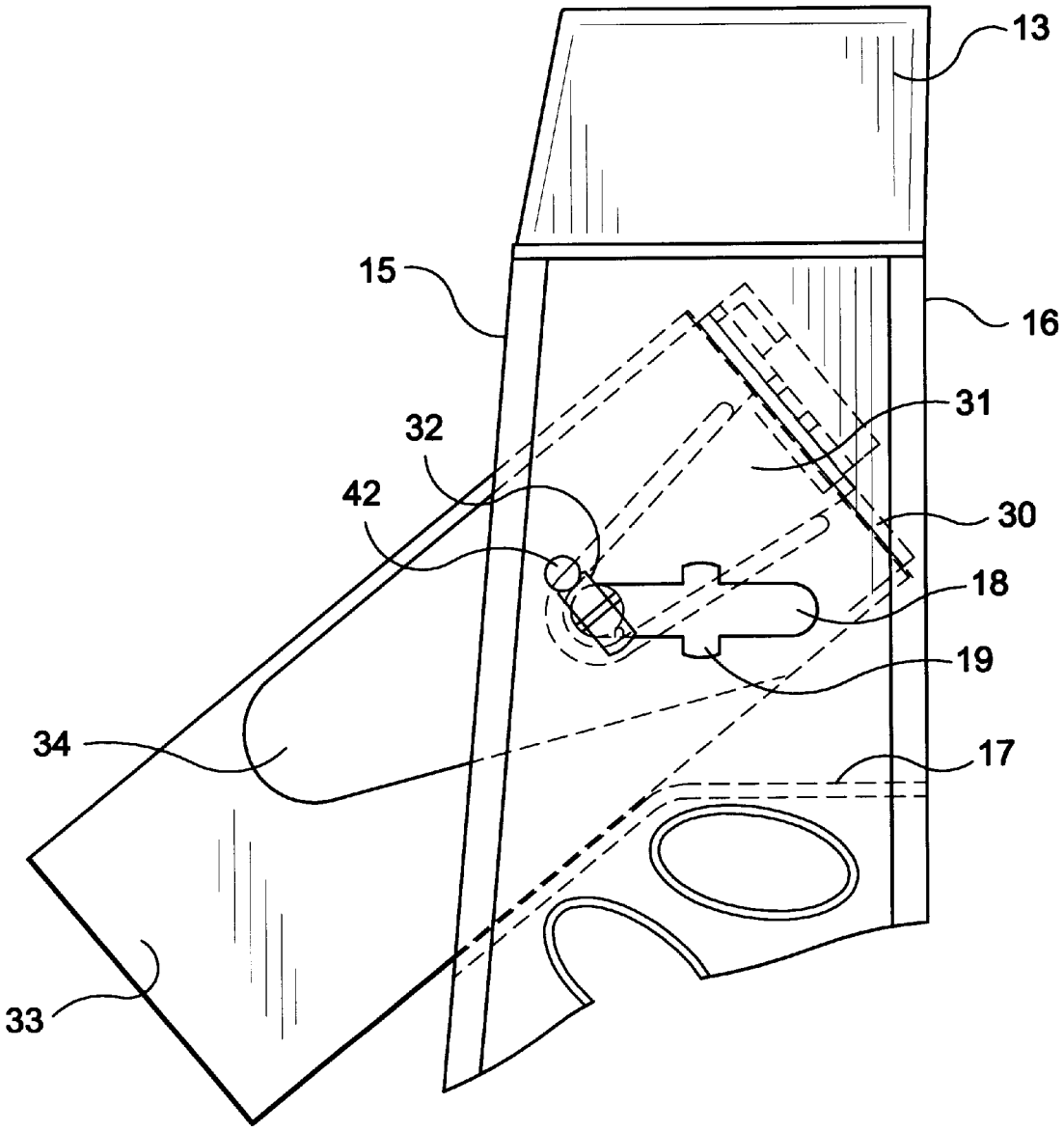
FIG. 6 is a closeup of a portion of the side view of the display rack with the boxes in the front position.

FIGS. 5 and 6 illustrate the display rack having the box inserted in the dispense position. In this position, the tabs are located at the portion of the horizontally elongated slots 18 which is adjacent to the front ends 15, 15A of the side walls. Due to the relative placement of the tabs in relation to the overall length of the box, the center of gravity of the box and product held within causes the box to be tipped so that it angles downward, resting lightly on the angled portion of the guide rails. In order to achieve the proper center of gravity, the pivot point is preferably located at a point approximately one third of the total length of the box from the back of the box. In the dispense position, the product will slide toward the front of the box 33 so that it may be more easily viewed and removed by potential customers. Further, once product is removed new, replacement product will slide to the front of the box to take its place. Tabs 32 may slide along the length of the elongated horizontal slots 18 such that the box and swing arm unit may be moved from the front to the back of the display rack and vice versa. Protrusion 41 (illustrated in FIGS. 3 and 4) is preferably located along the bottom of each horizontal slot to provide a means to prevent the box from returning to the shipping position when it is in the dispense position. Stabilizing means may be provided to aid in the stabilization of boxes which are in the front position. Preferably, the stabilizing means are in the form of pin 42 which is provided to aid in providing stability to the box when it is in the front position. To accomplish stability when the box is in the dispense position, tab 32 is first snapped over protrusion 41 and then dimpled portion 43 (illustrated in FIGS. 2 and 4) engages pin 42 to provide a tight snap fit.

Loading of the present display rack can be easily accomplished. Preferably, the goods to be displayed are in small packages 36 which are placed within box 33. Goods which are especially conducive to this sort of display rack are mints, gum, candy or any other item which may be sold in a small box or unit. As set forth above, box 33 is affixed to the swing arms and then the combination is inserted into the rack, preferably through the opening between back ends 16, 16A of the side walls. Tabs 32 are then engaged in elongated openings 19 and the combination may then be slid forward, along slots 18, into an angled position for ease of viewing by potential customers. In an alternative method of loading, the swing arm alone may be first inserted into the rack and the box may then be attached to the swing arm. For reloading, the combination may be removed from the display rack and a new box attached to the swing arms or, in the alternative, small packages of goods can simply be replaced in the larger box 33 when the supply is out or low. The manufacture of the display rack, boxes and swing arms is also easily accomplished. The display rack may be manufactured by molding the unit as a single, integral piece or as modular sections which are then attached to each other. The box is manufactured by simply folding cardboard in a manner such that the slots are created on either side. Finally, the swing arms are also manufactured through a molding process.

Figure 8:
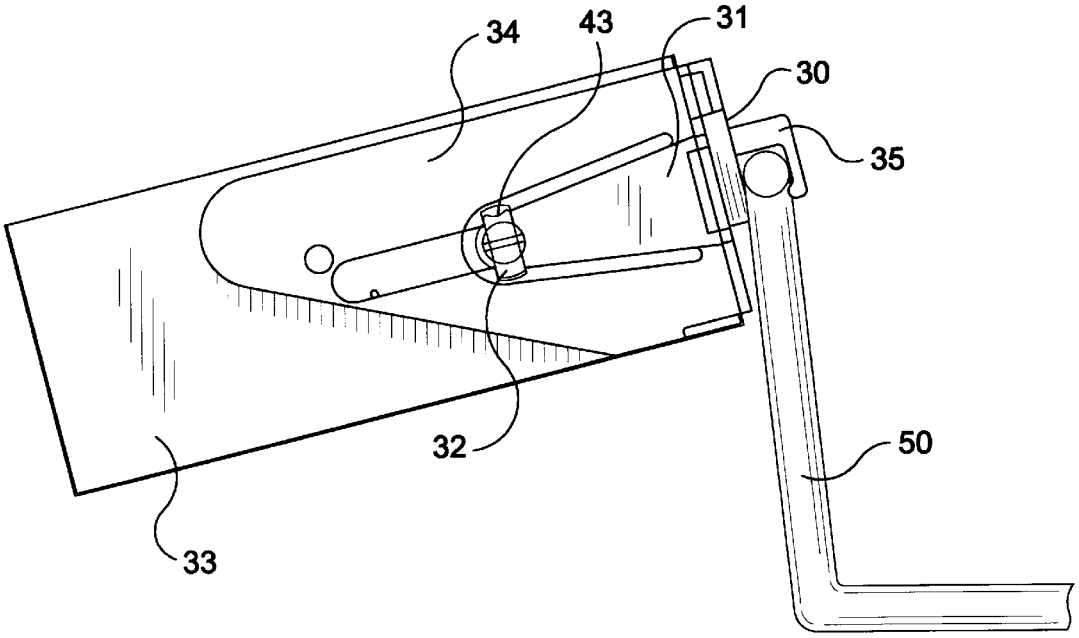
FIG. 8 is a side view of the swing arms attached to an independent display stand.

FIG. 8 illustrates an alternative embodiment of the present invention. In this embodiment, hook 35 is extended from base plate 30 such that the swing arm and box combination may be attached to a desired surface instead of the display rack. Hook 35 extends outward and engages the desired surface 50 and allows the box to be displayed from the surface without the use of the display rack.

Figure 9:
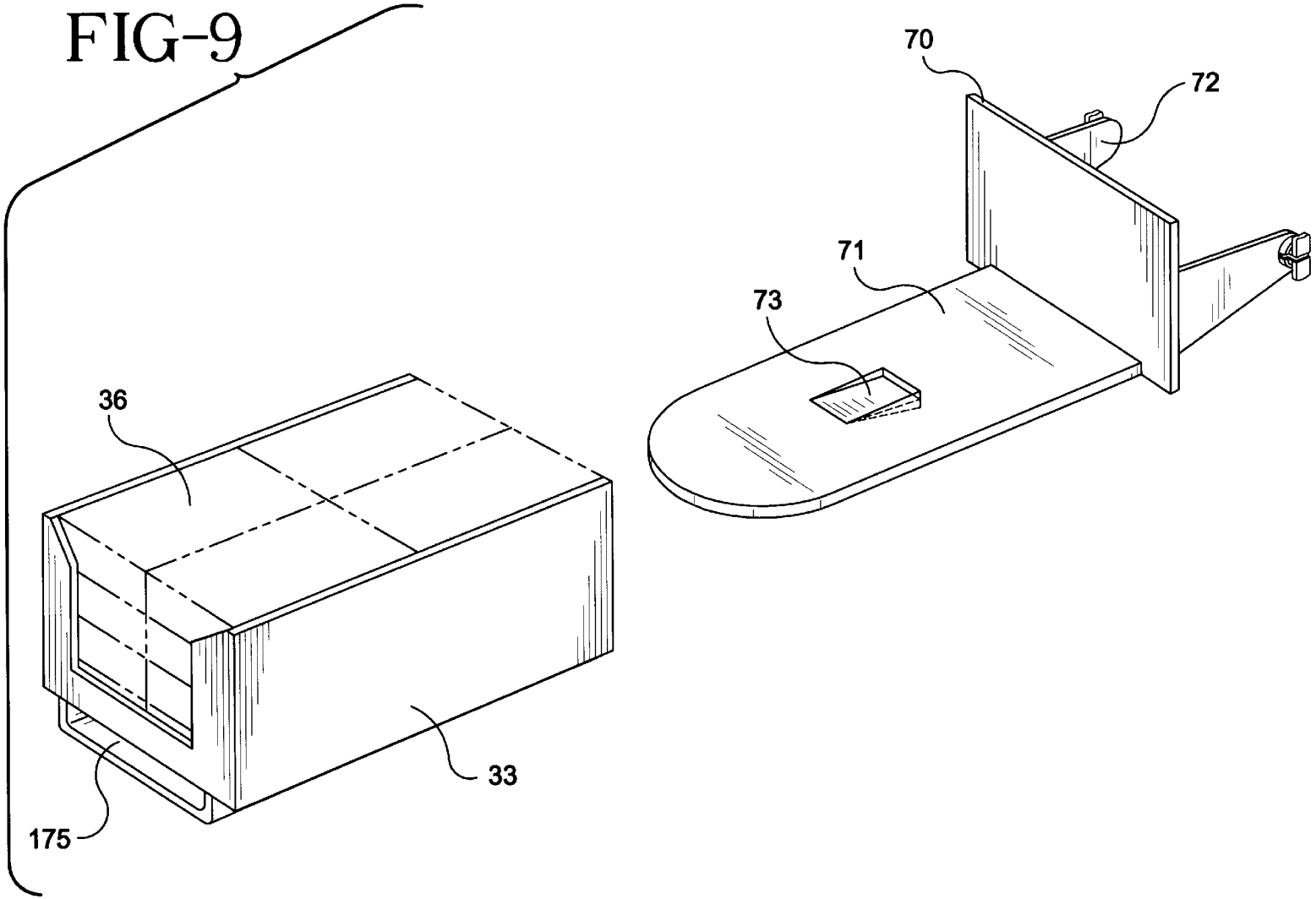
FIG. 9 is a perspective view of a further embodiment of the box attachment system.

FIG. 9 illustrates another alternative embodiment of the present invention. In this embodiment, a single engagement arm 71 extends outward from base plate 70. The engagement arm slides into slot 75 in box 33 to attach the arm and the box. Locking means, preferably in the form of clip 73 are provided on engagement arm 71 to firmly attach the box and the engagement arm. In a preferred embodiment, swing arms 72 may also be provided so that the base plate may also accommodate boxes having slots along their outer sides.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

We claim:

1. A display unit comprising:

a) a base;

b) a cap;

c) two opposing side walls, each side wall having a front end and a back end;

wherein one or more slots extend horizontally through each of the side walls, with each slot aligned with the slot on the opposing side wall, and one guide rail located between each side wall below each slot; and d) one or more units for attachment to a box of goods to be displayed comprising a base plate having two ends and two swing arms, wherein one swing arm is located near each end of the base plate and each swing arm comprises an elevated portion having a tab means and wherein each tab means is adapted to be removably disposed within one of the one or more slots to releasably attach the unit to the side walls of the display unit.

2. A display unit according to claim 1, wherein the portion of the guide rail located adjacent to the front end of the side walls is angled downward.

3. A display unit according to claim 2, wherein each slot has a vertically elongated portion.

4. A display unit according to claim 3, wherein each side wall has stabilizing means adjacent to the one or more slots for stabilizing an item inserted within the corresponding slot.

5. A display unit according to claim 4, wherein the stabilizing means comprises one or more protrusions.

6. A display unit according to claim 5, wherein the tab means comprise an elongated portion and a rounded portion.

7. A display unit according to claim 6, wherein the rounded portion of the tab means further comprises a dimpled portion.

8. A display unit according to claim 7, wherein the swing arms may be folded inwardly along the base plate or extended outwardly away from the base plate.

9. A display unit according to claim 8, wherein the swing arms are biased outwardly when the swing arms are extended away from the base plate.

10. A display unit according to claim 9, further comprising a box for displaying goods, wherein each side of the box comprises inner and outer side walls such that a pocket is formed between the inner and outer side walls of the box.

11. A display unit according to claim 10, wherein the box further comprises locking means for locking the box to the swing arms.

12. A display unit according to claim 1, wherein one or more side walls contain one or more cut out portions.

13. A method for displaying items to be sold comprising the steps of:

a) providing a display unit comprising:

i) a base;

ii) a cap;

iii) two opposing side walls, each side wall having a front end and a back end; wherein one or more slots extend horizontally through each side wall, with each slot aligned with the slot on the opposing side wall, and one guide rail located between each side wall below each slot; and iv) one or more units for attachment to a box of goods to be displayed comprising a base plate having two ends and two swing arms, wherein one swing arm is located near each end of the base plate and each swing arm comprises an elevated portion having a tab means and wherein each tab means is adapted to be removably disposed within one of the one or more slots to releasably attach the unit to the side wall of the display unit and resilient means to cause outward pressure to lock the swing arms to the two opposing side walls;

b) attaching a box of goods to be displayed to the swing arms;

c) inserting the box of goods to be displayed and the swing arms into an opening formed between the front and back ends of the two opposing side walls such that the tab means are placed within the slots; and d) sliding the tab means in the horizontal slots such that the box of goods and swing arm combination is movable toward the front ends of the side walls.

* * * * *